US005372655A

United States Patent [19]

Preisser et al.

[11] Patent Number: 5,372,655

[45] Date of Patent: Dec. 13, 1994

[54] METHOD FOR THE TREATMENT OF ALLOY STEELS AND REFRACTORY METALS

[75] Inventors: Friedrich Preisser, Büdingen; Peter Minarski, Rodenbach; Albrecht Melber, Darmstadt; Klaus Zimmerman, Alzenau, all of Germany

[73] Assignee: Leybold Durferrit GmbH, Cologne, Germany

[21] Appl. No.: 871,266

[22] Filed: Apr. 14, 1992

[30] Foreign Application Priority Data

Dec. 4, 1991 [DE] Germany ..... 4139975

[51] Int. Cl.[5] ..... C23C 8/26

[52] U.S. Cl. ..... 148/230; 148/237; 148/238; 148/316; 148/318; 148/319

[58] Field of Search ..... 148/230, 237, 238, 316, 148/318, 319

[56] References Cited

U.S. PATENT DOCUMENTS

| | | | |
|---|---|---|---|
| 2,596,981 | 5/1952 | Chenault et al. | 148/230 |
| 2,851,387 | 9/1958 | Low | 148/230 |
| 4,511,411 | 4/1985 | Brunner et al. | 148/237 |
| 4,793,871 | 12/1988 | Dawes et al. | 148/218 |
| 4,822,642 | 4/1989 | Cabrera et al. | 427/255.1 |
| 4,904,316 | 2/1990 | Dawes et al. | 148/318 |
| 4,975,147 | 12/1990 | Tahara et al. | 156/646 |
| 5,013,371 | 5/1991 | Tahara et al. | 148/231 |
| 5,141,567 | 8/1992 | Tahara et al. | 148/217 |

FOREIGN PATENT DOCUMENTS

| | | |
|---|---|---|
| 0242089 | 10/1987 | European Pat. Off. . |
| 0408168 | 1/1991 | European Pat. Off. . |
| 62-270761 | 11/1987 | Japan . |
| 2-118059 | 5/1990 | Japan . |

*Primary Examiner*—Richard O. Dean
*Assistant Examiner*—Robert R. Koehler
*Attorney, Agent, or Firm*—Felfe & Lynch

[57] ABSTRACT

Method for the treatment of alloy steels and refractory metals such as Ti, Zr and Nb, especially for depassivation and subsequent thermochemical surface treatment in a process chamber (1, 2) under the action of pressure and temperature, wherein, in a first process step, a first gas or gas mixture from the group $N_2$, $H_2$ or $NH_3$ is admitted for the depassivation into a process chamber (1), a pressure greater than 1 bar a and a temperature between 100° C. and 1,000° C. is established in the chamber (1), and in a second process step a second gas or gas mixture from the group of N-, C- or B-containing gases is admitted into a process chamber (1, 2) for the thermochemical surface treatment, and a temperature between 100° C. and 1,000° C. at a pressure greater than or equal to 1 bar a is established.

7 Claims, 1 Drawing Sheet

METHOD FOR THE TREATMENT OF ALLOY STEELS AND REFRACTORY METALS

BACKGROUND OF THE INVENTION

The invention relates to a method for the treatment of alloy steels and refractory metals such as Ti, Zr and Nb, for example, especially for depassivation and for subsequent thermochemical surface treatment in a process chamber under the action of pressure and temperature.

In the thermal treatment of surfaces (e.g., nitriding, carbonitriding or boriding) of alloy steels and refractory metals (e.g., Ti, Zr, Mo, W, Nb, Ta, V) the following difficulties have long been encountered due to the passive coatings covering the surface of the materials: The passive coatings consist usually of oxides and form a thin protective skin which disadvantageously prevents the unhampered diffusion of nonmetals, such as N, C and B, for example, during surface treatment. Consequently, in the case of the refractory metals, for example, diffusion is entirely prevented, and in the case of high-alloy steels it is partially prevented, resulting in irregular results.

In certain types of alloy steels a preoxidation is performed in order to achieve a uniform result of treatment. Impurities on the surfaces are thus oxidized and the pre-existing oxide coating is influenced. In many cases, therefore, the uniformity of the coating can be influenced. The coatings produced are very thin and always contain greater amounts of oxygen.

Now, it is the object of the present invention to condition the surfaces of the said materials by pretreating them such that an unhampered absorption of diffusible atoms will be possible during thermochemical treatment.

This object is achieved in accordance with the invention performing a treatment in several steps.

SUMMARY OF THE INVENTION

In a first step a first gas or gas mixture from the group $N_2$, $H_2$ or $NH_3$ is admitted into a process chamber for the depassivation, a pressure greater than 1 bar a, and a temperature between 100° C. and 1,000° C., are established in the chamber independently of one another, and in a second step a second gas or gas mixture from the group of gases containing N, C or B is admitted into a process chamber for the thermochemical surface treatment, and a temperature is established between 100° C. and 1,000° C. at a pressure greater than or equal to 1 bar a.

The depassivation of alloy steels and refractory metals is advantageously performed by a heat treatment in gas mixtures which contain $NH_3$ and/or $H_2$, for example, at temperatures between 100° and 1,000° C. and pressures greater than 1 bar, wherein the interfering oxide skin is reduced and the pure metal or alloy is covered with a thin nitride coating as protection against reoxidation. With pieces pretreated in this manner, uniform treatment results can be achieved and these pieces can advantageously be further treated in the same apparatus or transferred to another apparatus for further treatment, while the thin nitride coating applied to them provides protection against reoxidation. If the further treatment is performed at higher temperatures, e.g., carburizing or boriding, the nitride coating rapidly dissolves and offers no impediment to the diffusion of the elements into the surfaces.

The invention admits of a great variety of embodiments; two of them are represented by way of example in the appended drawings, wherein:

DESCRIPTION OF PREFERRED EMBODIMENTS

A refractory metal (e.g., Ti) is put into a treatment chamber 1 (FIG. 1) and heated to 800° C. Then $NH_3$ is admitted into the chamber and, at a pressure of 10 bar a, the passivated titanium is reduced. After this first process step of depassivation, the gas in the chamber is changed. $NH_3$ is replaced by $N_2$, and while the temperature remains the same, the second process step begins, namely the thermochemical treatment. This nitriding process is performed at a pressure of 30 bar a. The treatment time usually amounts to two to four hours and depends on the desired nitride coating thickness. As the end product after the second process step the desired TiN coating is obtained.

Figure 2:
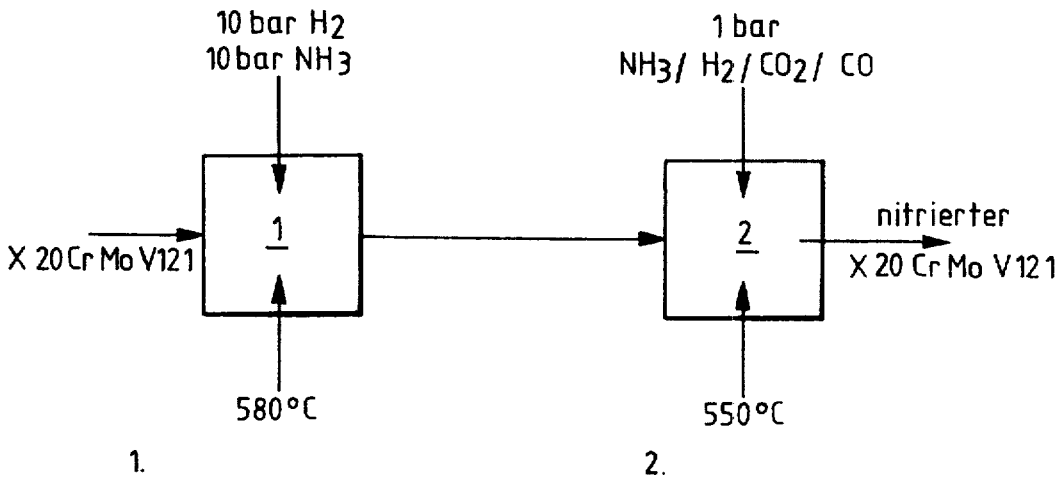

A second apparatus set-up is possible, which would consist of a combination of two different treatment chambers 1 and 2 (FIG. 2). This would find application, for example, in the treatment of mass steels, such as a high-alloy steel X 20 CrMoV 12 1.

After the steel is placed in the treatment chamber 1 the latter is heated to 580° C. and $H_2$ and/or $NH_3$ is admitted at a pressure of, for example, 10 bar a. In this first process step the steel is depassivated and at the same time provided with a thin nitride coating as protection against further oxidation.

Then the steel, protected against oxidation, is put into a second treatment chamber 2. Here a nitriding temperature specific for the material of 550° C. is established and a gas mixture of $NH_3$ and $H_2$ is admitted at a pressure of 1 bar a. After this second treatment step is completed the end product is a nitrided X 20 CrMoV 12 1 steel. Instead of gases containing nitrogen, gases containing carbon, such as $CO_2$ or CO can be used for carburizing at temperatures between 800° C. and 1,000° C.

Figure 1:
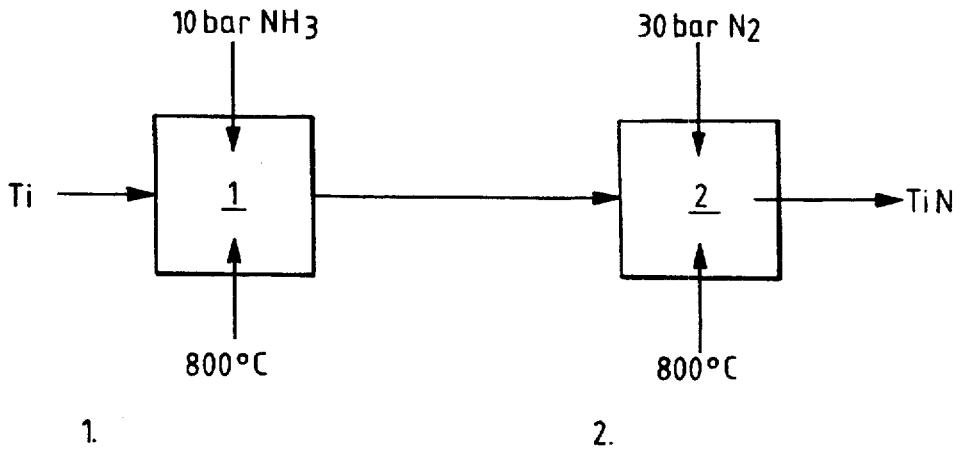
FIG. 1 represents an outline of a depassivation and a thermochemical treatment in a treatment chamber, and FIG. 2 an outline of a depassivation and a thermochemical treatment in two separate treatment chambers.

An important advantage of a two-part treatment apparatus according to FIG. 2 over an apparatus according to FIG. 1 is that the actual thermochemical treatment process, for example the nitriding, can be performed at atmospheric pressure in a conventional nitriding apparatus. This eliminates the need for a pressure chamber which, as represented in FIG. 1, must be designed, for example, for 30 bar a.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Method for the treatment of alloy steels and refractory metals, especially for depassivation followed by thermochemical surface treatment in a process chamber under the action of pressure and temperatures, comprising:

in a first process step admitting into a process chamber for depassivation a first gas consisting of $NH_3$ including establishing a pressure greater than 1 bar a and a temperature between 100° C. and 1,000° C., and in a second process step admitting a second gas consisting of $N_2$ into a process chamber in which $NH_3$ is substantially absent including establishing a temperature between 100° C. and 1,000° C. and a pressure equal to or greater than 1 bar a.

2. Method according to claim 1, in which in the first process step establishing a pressure comprises establishing a pressure of approximately 10 bar a.

3. Method according to claim 1, in which in the second process step establishing a pressure comprises establishing a pressure of 30 bar a in a chamber.

4. Method according to claim 1, which comprises performing the first and the second process steps in one and the same process chamber.

5. Method according to claim 1, which comprises performing the first process step in a first process chamber and performing the second process step in a second process chamber.

6. Method according to claim 1, which comprises performing the first process step in a first process chamber designed for a pressure greater than 1 bar a.

7. Method according to claim 1, which comprises performing the second process step in a second process chamber designed for atmospheric pressure.

* * * * *